US009070998B2

(12) United States Patent
Phillips et al.

(10) Patent No.: US 9,070,998 B2
(45) Date of Patent: Jun. 30, 2015

(54) HIGH SPEED ELECTRICAL CONTACT ASSEMBLY

(75) Inventors: David A. Phillips, Cobleskill, NY (US); Eric P. Hickey, Richfield Springs, NY (US)

(73) Assignee: Amphenol Corporation, Wallingford, CT (US)

( * ) Notice: Subject to any disclaimer, the term of this patent is extended or adjusted under 35 U.S.C. 154(b) by 137 days.

(21) Appl. No.: 13/560,666

(22) Filed: Jul. 27, 2012

(65) Prior Publication Data

US 2014/0030905 A1 Jan. 30, 2014

(51) Int. Cl.

| | |
|---|---|
| ***H01R 9/03*** | (2006.01) |
| ***H01R 13/506*** | (2006.01) |
| ***H01R 13/658*** | (2011.01) |
| ***H01R 13/6474*** | (2011.01) |
| ***H01R 13/6461*** | (2011.01) |
| *H01R 13/52* | (2006.01) |
| *H01R 13/59* | (2006.01) |
| *H01R 24/20* | (2011.01) |
| *H01R 24/28* | (2011.01) |

(52) U.S. Cl.

CPC ..... *H01R 13/506* (2013.01); *H01R 13/658* (2013.01); *H01R 13/6474* (2013.01); *H01R 13/521* (2013.01); *H01R 13/59* (2013.01); *H01R 13/6461* (2013.01); *H01R 24/20* (2013.01); *H01R 24/28* (2013.01)

(58) Field of Classification Search

USPC ..... 439/345, 607.41–607.52, 901, 903

See application file for complete search history.

(56) References Cited

U.S. PATENT DOCUMENTS

| | | | | |
|---|---|---|---|---|
| 4,734,057 | A | 3/1988 | Noschese | |
| 4,762,504 | A | 8/1988 | Michaels et al. | |
| 4,762,505 | A | 8/1988 | Asick et al. | |
| 5,102,353 | A | 4/1992 | Brunker et al. | |
| 5,707,252 | A | 1/1998 | Meszaros | |
| 5,895,292 | A | 4/1999 | Affeltranger et al. | |
| 5,997,349 | A * | 12/1999 | Yoshioka | 439/579 |
| 6,494,743 | B1 | 12/2002 | Lamatsch et al. | |
| 7,101,217 | B2 * | 9/2006 | Hayashi | 439/447 |
| 7,316,584 | B2 | 1/2008 | Mackillop et al. | |
| 7,534,138 | B1 | 5/2009 | Gump et al. | |
| 7,572,148 | B1 | 8/2009 | Pepe et al. | |
| 7,794,290 | B1 | 9/2010 | Joffe et al. | |
| 8,087,948 | B2 * | 1/2012 | Ambo et al. | 439/271 |
| 2007/0249214 | A1 | 10/2007 | Lamdiziz et al. | |
| 2013/0102176 | A1 * | 4/2013 | Kazubowski | 439/275 |

FOREIGN PATENT DOCUMENTS

| | | | |
|---|---|---|---|
| DE | 102006017448 | A1 | 10/2007 |
| EP | 1152498 | | 11/2001 |
| EP | 1152498 | A1 | 11/2001 |
| EP | 1422791 | A1 | 5/2004 |

(Continued)

*Primary Examiner* — Neil Abrams
*Assistant Examiner* — Travis Chambers
(74) *Attorney, Agent, or Firm* — Blank Rome LLP

(57) ABSTRACT

A contact assembly that comprises a conductive outer body that defines an outer perimeter and an insulative insert body that is receivable in that outer body. The insert body supports first and second contacts in a spaced arrangement. The insert body includes an area that surrounds the conductors between the conductors and the outer perimeter of the outer body, wherein the distance between the conductors and the outer perimeter of the outer body defined by the area of the insert body is substantially constant.

22 Claims, 3 Drawing Sheets

(56) References Cited

FOREIGN PATENT DOCUMENTS

| | | | |
|---|---|---|---|
| EP | 1858119 | A1 | 11/2007 |
| EP | 2058906 | A1 | 5/2009 |
| FR | 2921522 | | 3/2009 |
| JP | S57-174876 | | 10/1982 |
| JP | S62-165804 | | 1/1989 |
| JP | 2000-173828 | A | 6/2000 |
| JP | 2000-513137 | A | 10/2000 |
| JP | 2008-541354 | A | 11/2008 |
| WO | WO-2008098268 | A2 | 8/2008 |
| WO | WO-2010/115514 | A2 | 10/2010 |

* cited by examiner

HIGH SPEED ELECTRICAL CONTACT ASSEMBLY

RELATED APPLICATION

This application may be related to commonly owned and currently pending U.S. application Ser. No. 13/105,447, filed on May 11, 2011, and entitled High Speed Electrical Contact Assembly, the subject matter of which is herein incorporated by reference.

FIELD OF THE INVENTION

The invention relates to an electrical contact assembly that accommodates high speed data transfer with improved electrical performance.

BACKGROUND OF THE INVENTION

Current connection systems require increasingly higher reliability and data speed transmission. For example, current connection systems are required to meet standards, such as IEEE 802.3. IEEE 802.3 (a collection of standards relating to Ethernet), which is one of the most common computer-to-computer data communication methods. At higher speeds, however, the signal degrades due to crosstalk interference between conductors. That is particularly the case where the conductors are untwisted and terminated to a connector, such as a pin or socket. Also, the current connection system designs negatively impact signal integrity due to the round shape of the housing which results in decreased electrical performance. Additionally, current connection system designs are often bulky and therefore limit the density of the associated cabling.

Therefore, a need exists for a contact assembly that can accommodate high data speeds with better signal integrity while also providing a reduced size for high density applications.

SUMMARY OF THE INVENTION

The present invention generally provides a contact assembly that comprises a conductive outer body that defines an outer perimeter and an insulative insert body that is receivable in that outer body. The insert body supports first and second contacts in a spaced arrangement. The insert body includes an area that surrounds the conductors between the conductors and the outer perimeter of the outer body, wherein the distance between the conductors and the outer perimeter of the outer body defined by the area of the insert body is substantially constant.

The present invention may also provide a contact assembly that comprises a conductive outer body that defines an outer perimeter and an insulative insert body that is receivable in the outer body. The insert body includes an interface end and a cable termination end opposite the interface end. The insert body supports first and second contacts in a spaced arrangement. The insert body includes an area that surrounds the conductors between the conductors and the outer perimeter of the outer body. An insulator is received in that outer body adjacent to the cable termination end of the insert body. The insulator includes first and second passageways for accommodating terminal ends of the first and second contacts respectively, wherein the distance between the conductors and the outer perimeter of the outer body defined by the area of the insert body is substantially constant.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1A:
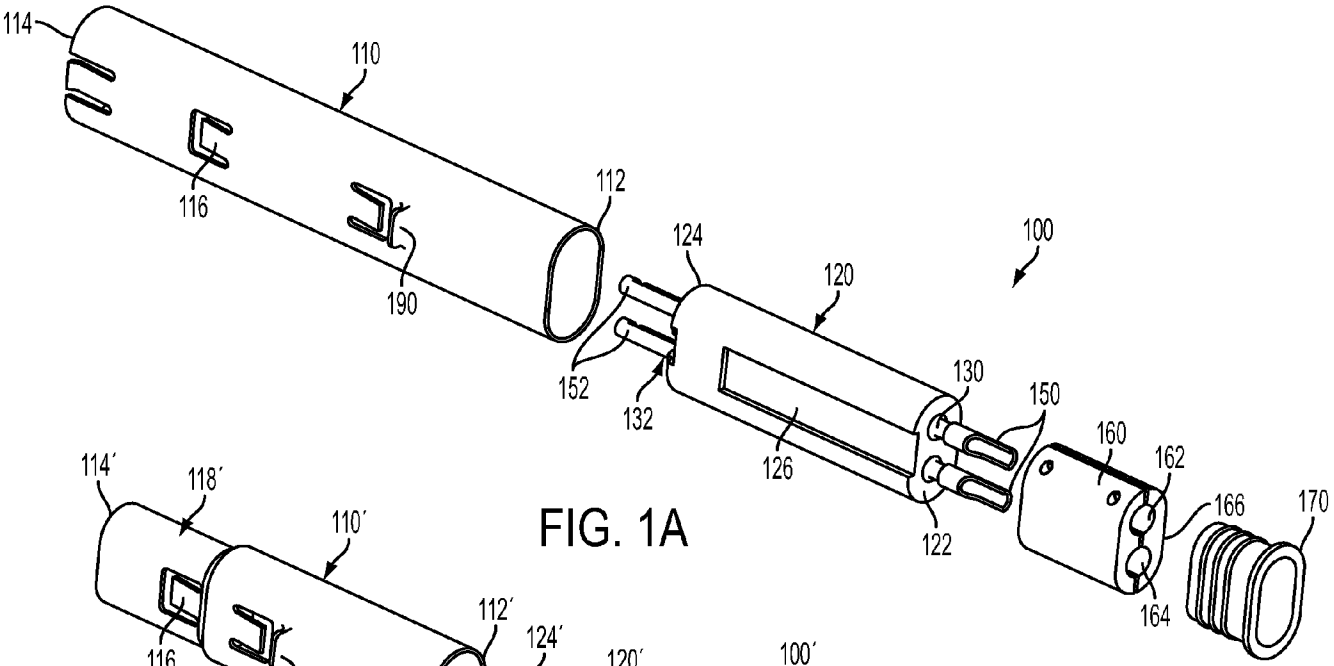
FIG. 1A is an exploded perspective view of a socket contact assembly according to an exemplary embodiment of the present invention.
Figure 1B:
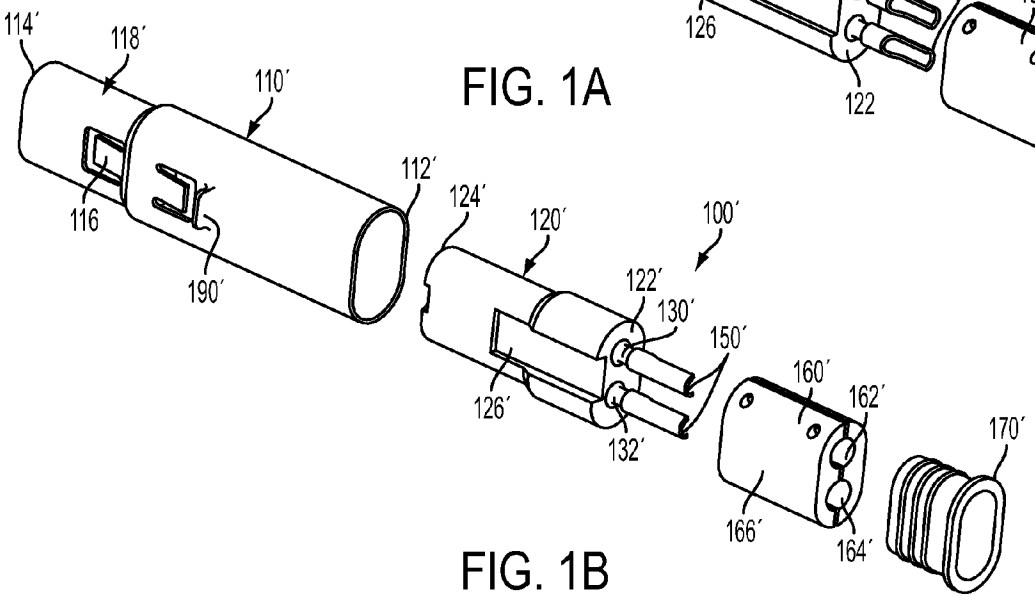
FIG. 1B is an exploded perspective view of a pin contact assembly according to an exemplary embodiment of the present invention.
Figure 2A:
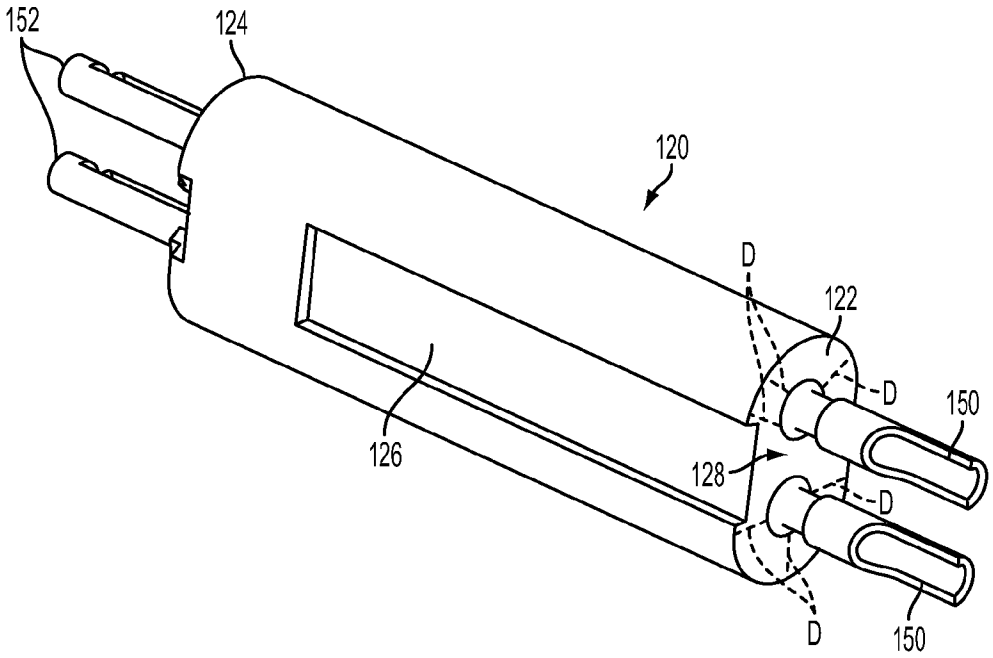
FIG. 2A is a perspective view of an insert body of the socket contact assembly illustrated in FIG. 1A.
Figure 2B:
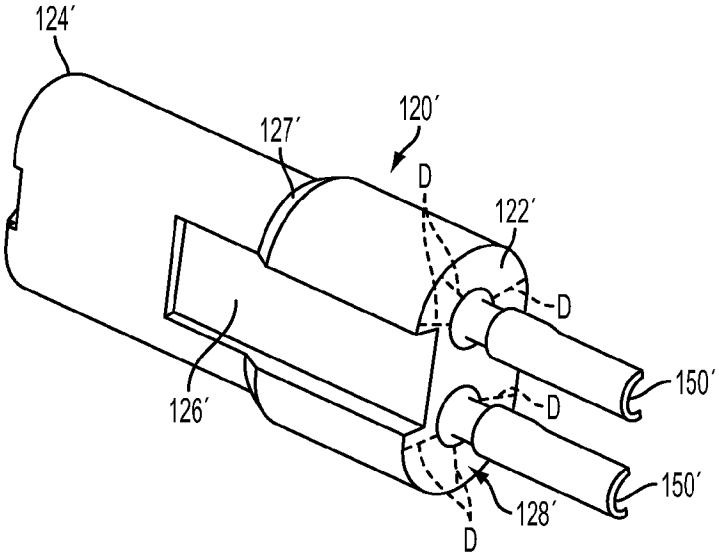
FIG. 2B is a perspective view of an insert body of the pin contact assembly illustrated in FIG. 1B.

Referring to FIGS. 1A, 1B, 2A, 2B, 3A, 3B, 4A, and 4B, the present invention relates to a contact assembly that reduces crosstalk and increases signal integrity in a reduced size and profile. The contact assembly relates to both a socket contact assembly 100 (FIGS. 1A, 2A, 3A, and 4A) and a pin contact assembly 100' (FIGS. 1B, 2B, 3B, and 4B).

The contact assembly of the present invention generally includes an outer body 110 (FIG. 1A) and 110' (FIG. 1B), an insert body 120 (FIG. 1A) and 120' (FIG. 1B) received in said outer body 110 and 110' (FIG. 1B), and first contacts 130 (FIG. 1A) and 130' (FIG. 1B) and second contacts 132 (FIG. 1A) and 132' (FIG. 1B) supported by said insert body 120 and 120'. The contacts are preferably a pair of differential signal contacts. The insert body of the present invention supports the first and second contacts with respect to the outer body such that the distance between the contacts and the outer body is constant or consistent all the way around the contacts. That is different from conventional designs, such as round bodies, which have irregular or inconsistent distances between the outer body and the contacts. Imbalance of the cross-sectional geometry of a differential contact pair leads to a higher capacitance which in turn may lead to increased attenuation throughout the contact assembly. Also, due to the round shape of the outer housing of a conventional contact assembly, there is wasted space within the contact assembly that increases the size of the contact assembly thus limiting the quantity of contacts which can be installed in a given connector. Thus, the oval or similar shape of the contact assembly of the present invention provides a reduced size contact assembly allowing for a high density of contact assemblies in the connector.

Figure 3A:
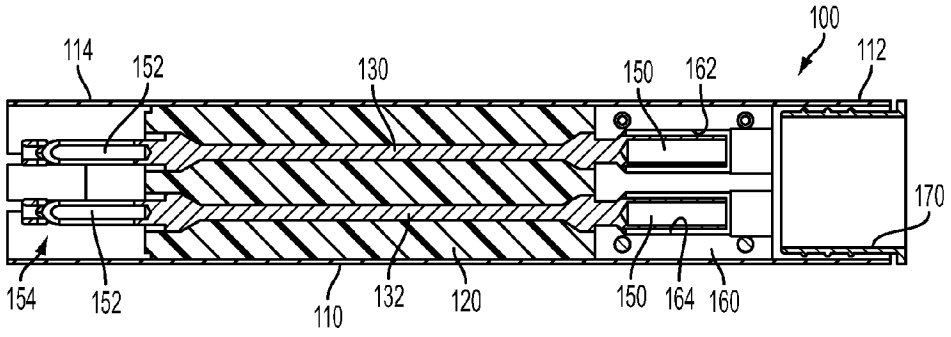
FIG. 3A is a cross-sectional view of the socket contact assembly illustrated in FIG. 1A.
Figure 3B:
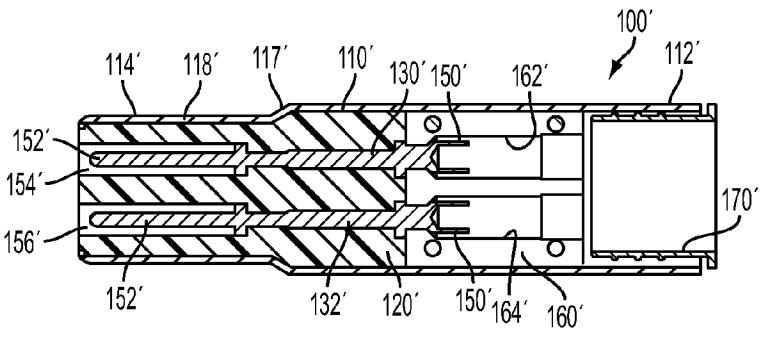
FIG. 3B is a cross-sectional view of the pin contact assembly illustrated in FIG. 1B.

The outer body 110 and 110' is hollow to receive the insert body 120 and 120' and is preferably formed of a conductive material to form a ground for the assembly. The outer body 110 and 110' has an end 112 (FIG. 3A) and 112' (FIG. 3B) for terminating to a cable and an opposite end 114 (FIG. 3A) and 114' (FIG. 3B) for engaging with its mating contact assembly. On at least one surface of the outer body 110 and 110' may include one or more engagement members, such as a tongue 116 (FIG. 1A) and 116' (FIG. 1B) for coupling to the insert body when it is inserted in the outer body. The tongue 116 and 116' preferably extends inwardly with respect to the outer body to catch the insert body. The outer body 110' of the pin contact assembly 100' preferably includes a step down 117' that defines a reduced portion 118' of the outer body 110', as best seen in FIG. 3B, for insertion into the interface end 114 (FIG. 3A) of the socket contact assembly 100. Stops 136 (FIG. 4A) and 136' (FIG. 4B) may be provided at the end of the outer body 110 and 110' to retain the insert body therein.

The insert body 120 (FIG. 2A) and 120' (FIG. 2B) is preferably made of an insulative material that is insert molded over the first contacts 130 and 130' and the second contacts 132 and 132' such that the contacts are supported in a spaced arrangement. The insert body may be formed of insulative materials, such as liquid crystal polymer and the like. The insert body has a cable termination end 122 (FIG. 3A) and 122' (FIG. 3B) and an opposite interface end 124 (FIG. 3A) and 124' (FIG. 3B). The insert body may include one or more engagement members, such an undercut 126 (FIG. 2A) and 126' (FIG. 2B) that corresponds to and engages the tongue 116 and 116' of the outer body 110 and 110'.

Figure 4A:
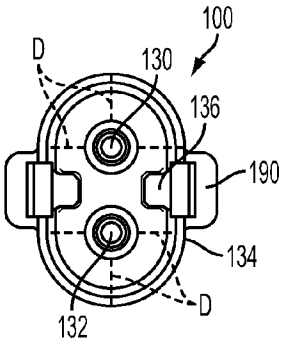
FIG. 4A is an end view of the socket contact assembly illustrated in FIG. 3A.
Figure 4B:
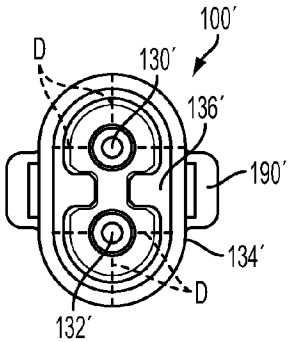
FIG. 4B is an end view of the pin contact assembly illustrated in FIG. 4B.

As best seen in FIGS. 2A, 2B, 4A and 4B, the insert body 120 and 120' defines an area 128 (FIG. 2A) and 128' (FIG. 2B) around the first contacts 130 and 130' and the second contacts 132 and 132' that preferably has an oval cross-sectional shape or other similar shape, such as rectangle with rounded ends or corners, that provides a constant distance D between the contacts and an outer perimeter 134 and 134' defined by the outer body all the way around the contacts. Similarly, the outer body 110 and 110' preferably has a cross-sectional shape that matches that of the insert body, as seen in FIGS. 4A and 4B. Within high speed electrical signal transmission lines, there is an inherent relationship to signal speed based on geometry because every time there is a change in the geometric boundary condition (the ground outer body) there is a signal velocity change imposed on the circuit. The smaller these changes are and the more controlled they are, the faster a signal can travel and the signal will remain "cleaner" and therefore more easily interpreted correctly. That is provided by the oval cross-sectional shape or other similar shape of the outer and insert bodies of the present invention. That is in contrast to conventional contact bodies which are typically round in cross-sectional shape and thus do not provide a consistent distance from the outer body to the contacts all the way around the contacts. The distance between the first contacts 130 and 130' and the second contacts 132 and 132' is also preferably the same as the distance D between the contacts and the outer perimeter 134 and 134' of the outer body. The insert body 120' of the pin contact assembly 100' may also include a step down portion 127' that corresponds to the step down 117' of the outer body 110', as best seen in FIG. 3B.

As seen in FIGS. 1A, 2A, 3A, and 4A, the first and second contacts 130 and 132 of the socket contact assembly 100 each include terminal ends 150 that are adapted to terminate to the cable and opposite contact ends 152 that are adapted to mate with the contacts 130' and 132' of the pin contact assembly 100'. The terminals ends 150 extend through the cable end 122 of the insert body 120 and the contact ends 152 extend through the interface end 124 of the insert body 120. A mating area 154 is defined between the end 114 of the outer body 110 and the contact ends 152 of the contacts 130 and 132 for engaging the pin contact assembly 100'.

Similar to the contacts of the socket contact assembly 100, the contacts 130' and 132' of the pin contact assembly 100' include terminal ends 150' that are adapted to terminate to the cable and opposite contact ends 152', as best seen in FIGS. 1B, 2B, 3B, and 4B. The terminal ends 150' extend through the cable end 122' of the insert body 120'. The opposite contact ends 152' of the contacts extend into first and second mating areas 154' and 156', respectively, disposed in the interface end 124' of the insert body 120, as best seen in FIG. 3B.

As seen in FIGS. 1A, 1B, 3A, and 3B, the socket contact assembly 100 and the pin contact assembly 100' may include an insulator 160 (FIG. 3A) and 160' (FIG. 3B), that supports the terminal ends 150 and 150' of the contacts between the insert body 120 and 120' and termination to the cable. The insulator 160 and 160' includes a first passageway 162 (FIG. 3A) and 162' (FIG. 3B) that receive the terminal ends 150 and 150' of the first contacts 130 and 130' and a second passageway 164 and 164' that receive the terminal ends 150 and 150' of the second contacts 132 and 132'. By providing the insulator 160 and 160', the signal integrity of the first contacts 130 and 130' and the second contacts 132 and 132' is maintained from the insert body 120 and 120' to the cable The insulator provides for a more controlled transition from rigid contact assembly to the controlled flexibility of the cable assembly as well as helping to reduce the risk of bridging the contacts with loose wire strands which may have not been terminated into the contacts properly or FOD (foreign Object Damage) which could be picked up during assembly. The insulator 160 and 160' is preferably formed of two identical halves 166 and 166' to facilitate assembly with the contacts. Also, a crimp ferrule 170 and 170' is preferably provided at the cable end 112 and 112' for crimping the cable, as is well known in the art.

The following assembly steps apply to both the socket contact assembly 100 and the pin contact assembly 100'. To assemble the contact assembly of the present invention, the outer jacket of the cable is stripped off for a predefined length to expose to the shield braid of the cable; the crimp ferrule 170 and 170' is slid onto the cable over the shield braid; the inner wires of the cable are trimmed to proper length; a predetermined length of insulation is trimmed off the inner wires to expose the center conductors of the cable; the terminal ends 150 and 150' of the contacts of the insert body 120 and 120' are each terminated to the center conductors of the cable (using either solder or crimp termination method based on part number and design); the insulator 160 and 160' is installed over terminated contact ends 150 and 150' and the cable wires; the insert body 120 and 120' and the insulator 160 and 160' with the contacts terminated to the cable are slid into the outer body 110 and 110' until the tongue 116 and 116' catches the undercut 126 and 126' of the insert body for a snap-in engagement therebetween; and the shield braid of the cable is terminated to the crimp ferrule 170 and 170' and the outer body 110 and 110'.

The socket contact assembly 100 and the pin contact assembly 100' are mated by inserting the reduced portion 118' of the pin contact assembly 110' into the interface end 114 of the outer body 110 of the socket contact assembly 100. The contacts 130' and 132' of the pin contact assembly 100' are received in the mating area 154 of the socket contact assembly and the contacts 130 and 132 of the socket contact assembly 100 are received in the mating areas 154' and 156' of the pin contact assembly 100' such that the contact ends 152 and 152' of the contacts 130, 130', 132, and 132' connect for electrical and mechanical engagement therebetween.

As seen in FIGS. 1A, 1B, 4A and 4B, the outer body 110 and 110' of the socket and pin contact assemblies 100 and 100' may be provided with one or more outwardly extending tabs 190 and 190' that engage the main connector to retain the contact assemblies therein.

While particular embodiments have been chosen to illustrate the invention, it will be understood by those skilled in the art that various changes and modifications can be made therein without departing from the scope of the invention as defined in the appended claims. For example, although the contact assembly is designed for 2 pairs of conductors, the contact assembly may be designed to accommodate any number of contacts including 1 or more pairs of conductors.

What is claimed is:

1. A contact assembly, comprising:

a conductive outer body, said outer body defining an outer perimeter; and an insulative insert body receivable in said outer body, said insert body supporting first and second contacts in a spaced arrangement, and said insert body including an area that surrounds said contacts between said contacts and said outer perimeter of said outer body, wherein the distance between said contacts and said outer perimeter of said outer body defined by said area of said insert body is substantially constant.

2. A contact assembly according to claim 1, wherein each of said insert body and said outer body has a cross-sectional shape that is substantially oval.

3. A contact assembly according to claim 1, wherein said insert body is formed of a liquid crystal polymer.

4. A contact assembly according to claim 1, wherein said insert body is insert molded over said first and second contacts.

5. A contact assembly according to claim 1, wherein said insert body has a socket interface end through which contact ends of said first and second contacts extend such that a mating area is defined between said contact ends and said outer body for engaging a pin interface.

6. A contact assembly according to claim 1, wherein said insert body having an interface end through which said first and second contacts extend for mating with another contact assembly; and said insert body having a cable end opposite said interface end, said cable end being adapted to terminate to a cable.

7. A contact assembly according to claim 6, therein each of said first and second contacts has a terminal end for terminating to a cable and a contact end for engaging a mating contact.

8. A contact assembly according to claim 1, wherein said insert body and said outer body include corresponding engagement members.

9. A contact assembly according to claim 8, wherein said engagement members form a snap engagement.

10. A contact assembly according to claim 1, wherein said insert body has a pin interface end that includes first and second mating areas that receive contact ends of said first and second contacts, respectively, for engaging a socket interface.

11. A contact assembly according to claim 10, wherein said outer body and said insert body include a step down, thereby defining a reduced portion of said outer body and insert body at said pin interface end.

12. A contact assembly, comprising a conductive outer body, said outer body defining an outer perimeter;

an insulative insert body receivable in said outer body, said insert body including an interface end and a cable termination end opposite said interface end, said insert body supporting first and second contacts in a spaced arrangement, and said insert body including an area that surrounds said contacts between said contacts and said outer perimeter of said outer body; and an insulator received in said outer body adjacent to said cable termination end of said insert body, said insulator including first and second passageways for accommodating terminal ends of said first and second contacts respectively, wherein the distance between said contacts and said outer perimeter of said outer body defined by said area of said insert body is substantially constant.

13. A contact assembly according to claim 12, wherein said insulator includes first and second identical halves.

14. A contact assembly according to claim 12, wherein said first and second contacts include terminal ends opposite said contact ends for terminating a cable.

15. A contact assembly according to claim 2, further comprising a crimp ferrule disposed in said outer body such that said insulator is sandwiched between said cable termination end of said insert body and said crimp ferrule.

16. A contact assembly according to claim 12, wherein said insert body is formed of a liquid crystal polymer.

17. A contact assembly according to claim 12, wherein said insert body is insert molded over said first and second contacts.

18. A contact assembly according to claim 12, wherein said insert body has a socket interface end through which contact ends of said first and second contacts extend such that a mating area is defined between said contact ends and said outer body for engaging a pin interface.

19. A contact assembly according to claim 12, wherein said insert body and said outer body include corresponding engagement members.

20. A contact assembly according to claim 19, wherein said engagement members form a snap engagement.

21. A contact assembly according to claim 12, wherein said insert body has a pin interface end that includes first and second mating areas that receive contact ends of said first and second contacts, respectively, for engaging a socket interface.

22. A contact assembly according to claim 21, wherein said outer body and said insert body include a step down, thereby defining a reduced portion of said outer body and insert body at said pin interface end.

* * * * *